United States Patent [19]

Clipson et al.

[11] 4,109,791

[45] Aug. 29, 1978

[54] NESTABLE AND STACKABLE CONTAINER ASSEMBLY WITH IMPROVED BAIL STRUCTURES OF MOLDED PLASTIC

[75] Inventors: Stuart A. Clipson, Glendale; Ralph H. Herolzer, Cincinnati, both of Ohio

[73] Assignee: Midland-Ross Corporation, Cleveland, Ohio

[21] Appl. No.: 444,967

[22] Filed: Feb. 22, 1974

[51] Int. Cl.[2] ..... B65D 21/06

[52] U.S. Cl. ..... 206/506

[58] Field of Search ..... 206/506, 507, 519, 518; 220/343

[56] References Cited

U.S. PATENT DOCUMENTS

| | | | |
|---|---|---|---|
| 1,676,621 | 7/1928 | Pittelrow | 220/343 |
| 2,175,390 | 10/1939 | Harrizon | 206/506 |
| 2,244,841 | 6/1941 | Johnson | 206/506 |
| 2,765,099 | 10/1956 | Lively | 206/506 |
| 2,766,901 | 10/1956 | Sunko | 220/343 |
| 3,191,796 | 6/1965 | Schwartz | 206/507 |
| 3,430,806 | 3/1969 | Munk | 206/507 |
| 3,586,205 | 6/1971 | Van Daalen | 206/506 |

*Primary Examiner*—George E. Lowrance

*Attorney, Agent, or Firm*—H. Duane Switzer

[57] ABSTRACT

A nestable and stackable container assembly including a nestable container body molded of plastic material and a pair of bail structures also molded of plastic material pivotally mounted on the end walls of the container body for movement between nesting positions permitting a plurality of like container assemblies to nest one within another and stacking positions enabling a plurality of like containers to stack one on top of the other, the end walls and bail structures being constructed to provide strength and support when stacked without providing excessive wall thicknesses or excessive reduction in nesting height or container capacity, the container body and bail structures having integrally formed cooperating rounded projections for yieldingly resisting movement of the bail structures out of either their stacking positions or nesting positions.

12 Claims, 13 Drawing Figures

NESTABLE AND STACKABLE CONTAINER ASSEMBLY WITH IMPROVED BAIL STRUCTURES OF MOLDED PLASTIC

This invention relates to container assemblies and more particularly to container assemblies of the nestable and stackable type.

Nestable and stackable container assemblies of the type including nestable container bodies provided with bail structures movable between a position permitting nesting of the container bodies and a position permitting the container bodies to be stacked one above the other are well known. The use of nestable and stackable containers molded of plastic material, such as polyethylene, has become widespread in recent years and such use is continuing to increase. The nestable and stackable plastic containers which have achieved widespread usage thusfar have been of the 90° or 180° stackable and nestable type, rather than of the bail structure type. To some extent, the lack of increased popularity of bail type container assemblies has been as a result of the use of metal rods and the like in the bail structures. Heretofore, it was felt that metalic material was required in constructing the bails due to the strength required, however, metalic material suffers from a distinct disadvantage in comparison with plastic material such as polyethylene in that it is more subject to corrosion and is therefore much more difficult to keep clean. Consequently, there is a need for a nestable and stackable container assembly of the bail structure type in which the bail structures are likewise molded of plastic material so as to achieve the advantages of ease in cleaning, etc. inherent in this type of construction as compared to metalic construction, which at the same time, provides the strength characteristics heretofore provided by metalic bail structures.

Providing the necessary strength characteristics constitutes a major problem in satisfying the abovementioned need. In the normal use of containers of this type a stack of filled container assemblies can reach as high as eight and more, resulting in a sizeable load being carried by the bail structures of the lowermost container assembly of the stack. These required strength characteristics can not be provided efficiently by simply forming the container assembly of heavier walls. Heavier walls increase the costs and weight of the container assemblies and reduce the nesting height capabilities thereof. Moreover, full bottom support of the bail structures can not be provided and still maintain the nesting capability of the container body.

Accordingly it is an object of the present invention to provide a nestable and stackable container assembly of the plastic bail structure type having an improved cooperating support construction between the walls of the container body carrying the bail structures and the bail structures themselves, which construction efficiently provides the required strength characteristics, as aforesaid, without excessive wall thicknesses and without substantially reducing the nesting height of the container assemblies.

Another one of the problems inherent in the utilization of molded plastic bail structures is that due to their inherently less structural strength in comparison with metal, if the ends of the bail structures protrude outwardly of the side walls of the container assembly they are subject to excessive damage. On the other hand, container capacity is reduced where internal surfaces are provided for supporting the ends of the bail structures in their stacking positions.

It is another object of the present invention to provide a nestable and stackable container assembly of the bail structure type in which the bail structures are molded of plastic material and have their ends supported in stacking positions by an improved lug construction integrally formed on the adjacent side walls in such a way as to enable the ends of the bail structure to cooperate therewith without protruding from the exterior surfaces of the side walls.

Another advantage which can be obtained in bail structures of molded plastic material is that integral surfaces can be molded on the bail structures and container body which serve to limit the movement of the bail structures between their stacking and nesting positions and yieldingly resist the movement of the bail structures out of either of such positions. The provision of this type of action is highly advantageous in use since the bail structures tend to remain in the desired position, either stacking or nesting, as the container assemblies are moved about and yet are capable of movement from one position to the other by a simple flipping action.

Accordingly, it is a further object of the present invention to provide a nestable and stackable container assembly of the type described having interengaging cam surface means integrally molded on the bail structures and container body for yieldingly restraining movement of the bail structures out of either the stacking position thereof or the nesting position thereof.

Another object of the present invention is the provision of an improved hinge construction which is particularly useful in effecting the pivotal connection between the plastic bail structures and plastic container body of the present container assembly.

Another object of the present invention is the provision of a nestable and stackable container assembly of the type described which is simple in construction, effective in operation, and economical to manufacture.

These and other objects of the present invention will become more apparent during the course of the following detailed description and appended claims.

The invention may best be understood with reference to the accompanying drawings wherein an illustrative embodiment is shown.

Figures 1, 9, 10, 11, 12:
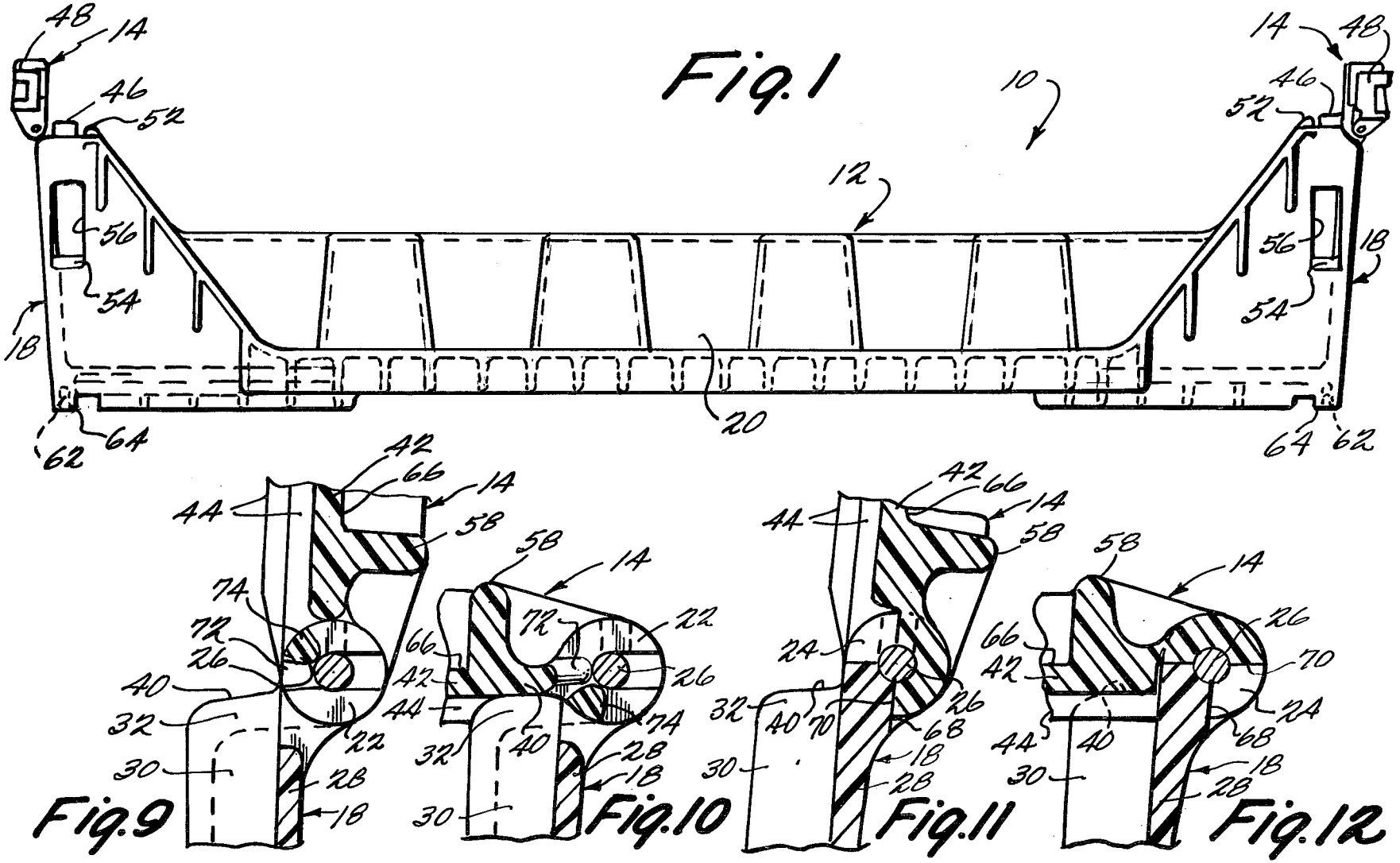
FIG. 1 is a side elevational view of a container assembly embodying the principles of the present invention with the bail structures shown in their nesting positions.
FIG. 9 is an enlarged fragmentary sectional view taken along the line 9—9 of FIG. 2.
FIG. 10 is a view similar to FIG. 9 showing the bail structure in its stacking position.
FIG. 11 is an enlarged fragmentary sectional view taken along the line 11—11 of FIG. 2.
FIG. 12 is a view similar to FIG. 11 showing the bail structure in its stacking position.
Figures 2, 8:
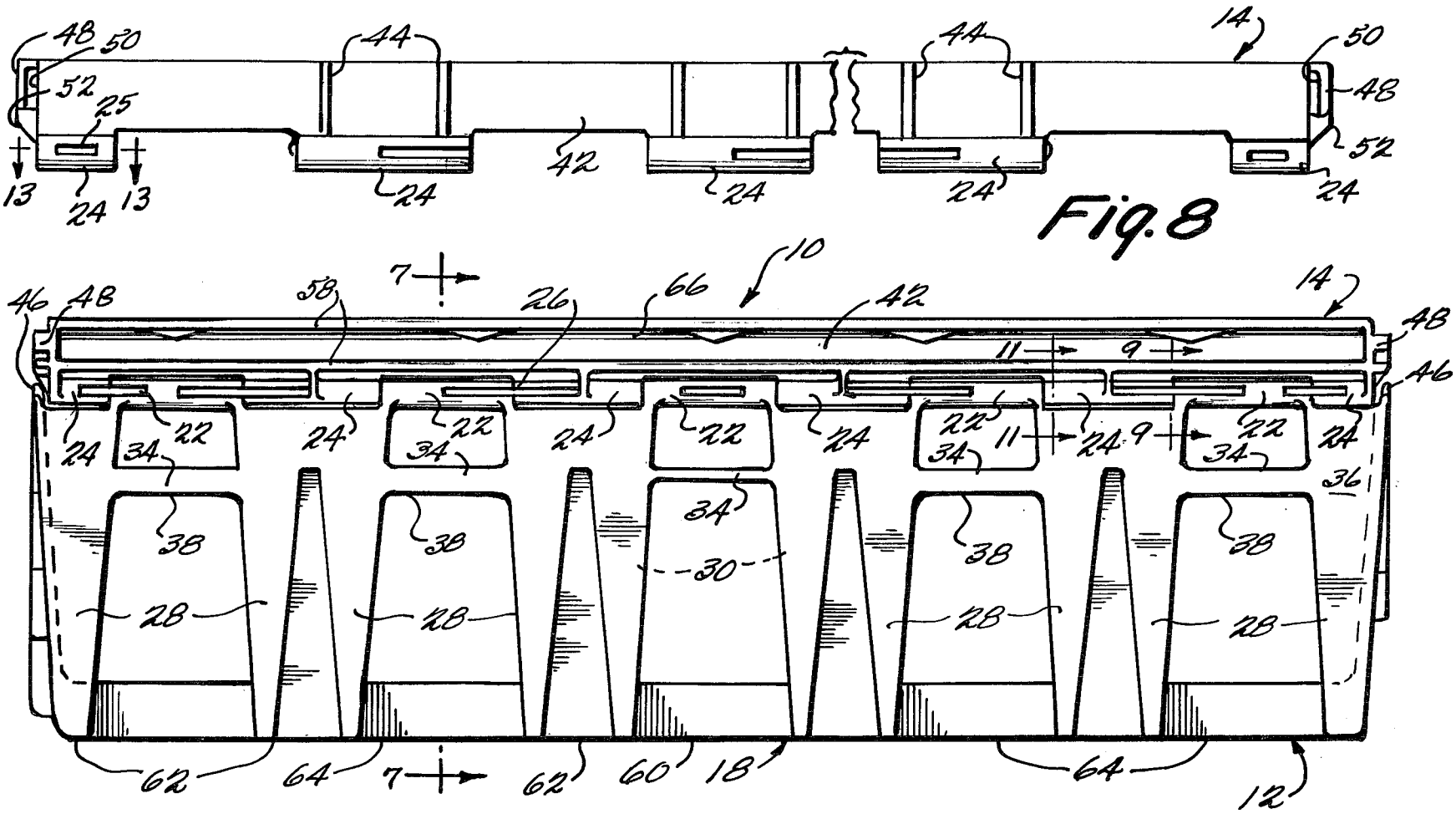
FIG. 2 is an enlarged end view of the container assembly shown in FIG. 1.
FIG. 8 is a bottom view of a bail structure of the container assembly.
Figure 3:
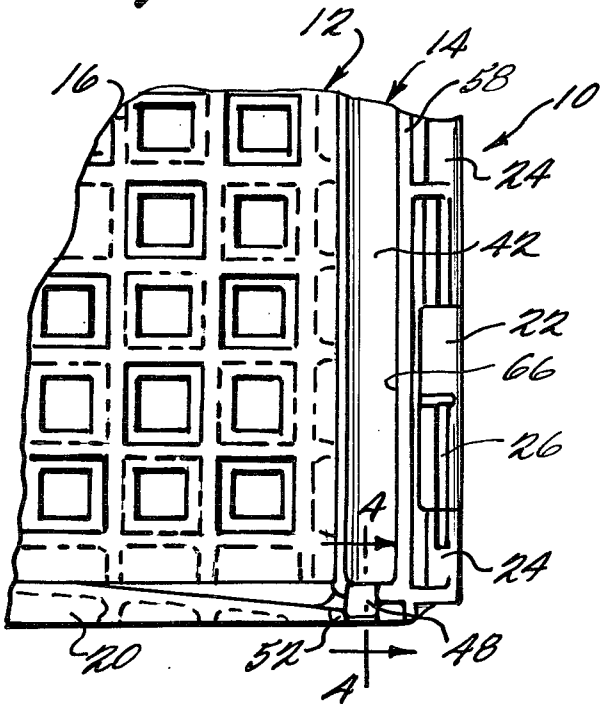
FIG. 3 is a fragmentary top plan view of one corner of the container assembly with the bail structure shown in its stacking position.

Referring now more particularly to the drawings, there is shown in FIGS. 1–3 thereof, a container assembly, generally indicated at 10, embodying the principles of the present invention. The container assembly includes a container body, generally indicated at 12, which is molded as a unitary structure of a suitable plastic material, such as polypropylene or the like, and a pair of bail structures, generally indicated at 14, also molded of a suitable plastic material such as polypropylene or the like, which are mounted on the container body for movement between nesting and stacking positions with respect thereto.

The container body 12 includes a generally horizontally extending bottom wall 16, which is preferably of rectangular configuration in plan, and two pairs of opposed side walls 18 and 20 integrally joined together and extending upwardly from the periphery of the bottom wall. The bottom wall may be of square configuration, hence the designation of the walls extending upwardly therefrom as side walls. With the preferred elongated rectangular configuration shown, the side walls of lesser horizontal extent are properly designated end walls. In the preferred embodiment the bail structures are mounted on these end walls but here again, it will be understood that it is within the contemplation of the present invention to mount the bail structures on the side walls of large horizontal extent rather than the end walls. Thus, as a convenience in description the side walls of lesser horizontal extent will be hereinafter referred to as the end walls.

The end walls 18 and side walls 20 of the container body 12 are configured so that a container body of like construction can be disposed in nested relation therein and vice versa. In order to permit two container bodies 12 to be disposed in nested relation, the bail structures 14 of the lowermost container assembly must be disposed in their nested positions, as illustrated in FIGS. 1 and 2. In this position, it will be noted that the bail structures are disposed outwardly of the adjacent interior surfaces of the end walls 18. As previously indicated, the bail structures 14 are mounted on the end walls for movement between the nesting positions, as illustrated in FIGS. 1 and 2, and stacking positions, as illustrated in FIG. 3. In the stacking positions of the bail structures, the bail structures extend inwardly of the adjacent interior surfaces of the end walls.

Preferably, the bail structures are mounted for movement between the nesting and stacking positions thereof by a pivotal action and, to this end, each end wall 18 is provided with a plurality of longitudinally spaced pivot portions 22 formed integrally along the upper outer edge portions thereof. Each bail structure 14 is provided with a plurality of longitudinally spaced pivot portions 24 positioned complementary to the pivot portions 22 of the associated end wall. Each of the pivot portions is generally cylindrical in exterior configuration and has formed therein throughout the longitudinal extent thereof one or a pair of U-shaped grooves, the inner portion of which are concentric with the axis of the cylindrical configuration of the pivot portion so as to provide a continuous opening extending longitudinally through the pivot portions, when disposed in complementary relation, within which a pivot pin 26 is mounted in order to establish the pivotal connection.

Figure 13:
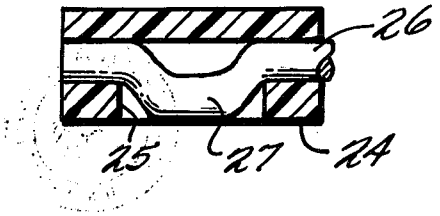
FIG. 13 is an enlarged fragmentary sectional view taken along the line 13—13 of FIG. 8 showing the cooperation between the pivot pin and the pivot portion of the bail structure shown in FIG. 8.

As best shown in FIG. 13, in order to retain the pivot pin 26 against longitudinal displacement with respect to the pivot portions 22 and 24, the pivot pin 26 is formed with a laterally offset portion 27, which in the preferred embodiment shown is provided by bending the metal material of the pivot pin 26. One of the pivot pin openings, indicated at 25, extends laterally to the exterior of the associated pivot position (e.g. an end pivot portion 24) in a position intermediate the ends thereof. The longitudinal extent of the opening 25 is generally equal to the longitudinal extent of the bent offset portion 27 so as to receive the same therein. The engagement of the offset portion 27 within the opening 25 is effected by material deformation of the associated pivot portion 24 during the longitudinal movement of the pivot pin 26 into the continuous openings provided by the interengaged pivot portions. Once the offset portion 27 is engaged within the opening 25, the engagement serves to retain the pivot pin against longitudinal displacement within the openings.

The construction of the end walls 18 is so related to the construction of the bail structures 14 as to provide for the support of the bail structures in both their nesting and stacking positions. In the preferred embodiment shown, each end wall 18 is constructed with a plurality of horizontally spaced panel sections 28 which are inclined upwardly and outwardly with respect to the associated edge of the bottom wall 16 to a degree sufficient to permit nesting. The horizontal spacing of the panel sections 28 is interrelated with the associated pivot portions 22 so that the panel sections are positioned between adjacent pivot portions and at each end of the end wall. Moreover, in addition to the upward and outward inclination of the panel sections 28, each panel section is provided with side edges which diverge with respect to each other in an upward direction and are provided throughout the vertical extent thereof with inwardly directed tapered flanges 30. Also in the preferred embodiment shown, the central portion of the interior panel sections 28 is formed with upwardly converging recesses in the lower central portion thereof.

Extending horizontally between each pair of adjacent flanges 30 associated with adjacent panel sections 28 is a horizontal ledge 32 which likewise is integrally connected with an associated pivot portion 22 and extends horizontally inwardly thereof. Disposed in vertically spaced parallel relation below each ledge 32 is a horizontally extending strengthening element 34. These elements are spaced below the ledges a distance generally equal to the nesting height of the container body. The portions of each end wall disposed vertically above the strengthening elements 34 are preferably strengthened by substantially vertically extending panel sections 36, each of which interconnects the upper inner edge of an element 34 with the inner edges of the flanges 30 and ledge 32 associated therewith. The portions of each end wall disposed vertically below the elements 34 are open to receive therein, during nesting, the ledges, panel portions and elements 34 of a like container.

Figure 7:
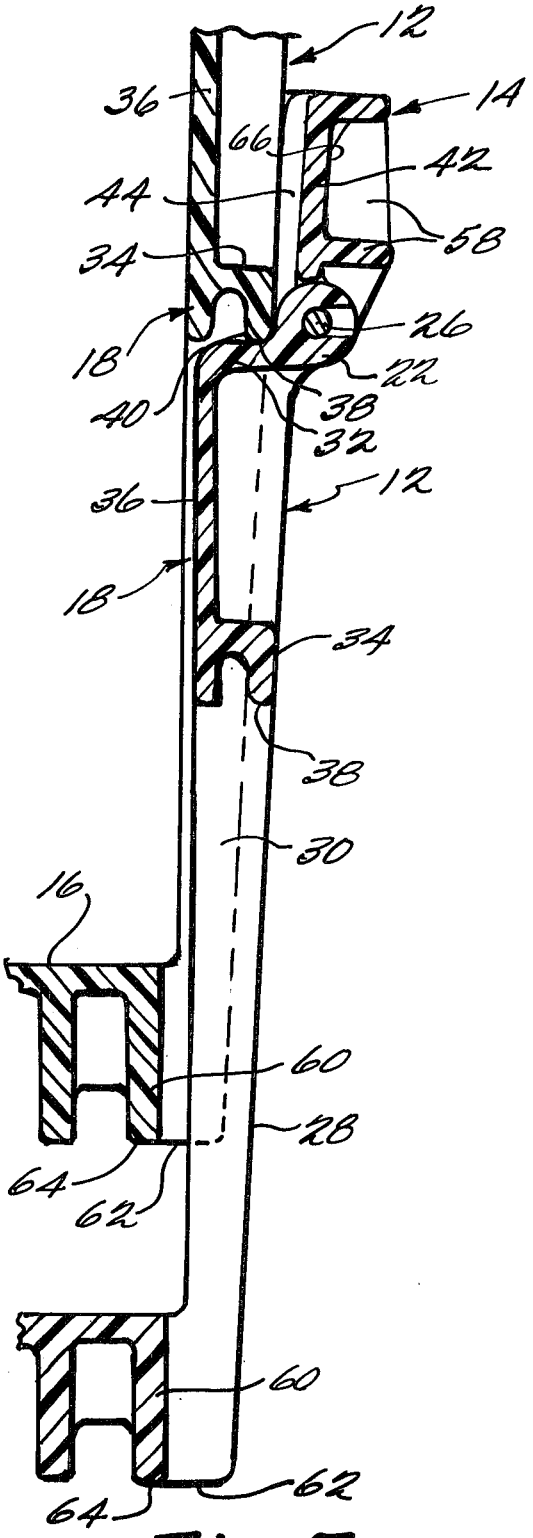
FIG. 7 is a view similar to FIG. 6 taken along the line 7—7 of FIG. 2.

It can thus be seen that the construction as described above will enable each end wall 18 to be disposed in nested relation with an end wall of a similar container body. It will also be noted that when two similar container bodies are disposed in such nested relation, the ledges 32 of each end wall of the lowermost container body will engage within the openings disposed below each of the horizontal elements 34 of the end walls of the uppermost container body. In order to prevent two such container bodies from becoming wedged in nested relation, all but the central elements 34 are provided with downturned exterior flanges which define downwardly facing nesting stop surfaces 38. These surfaces 38 are disposed in vertical alignment with upwardly facing nesting stop surfaces 40 provided by the ledges 32, as can be clearly seen from FIG. 7. The downturned flange providing the stop surface 38 is omitted from central elements 34 so that the latter will present smooth lower surfaces of relatively large area suitable to be gripped manually for purposes of handling the container body.

The nesting stop surfaces 40 also serve as support surfaces for supporting the bail structures 14 in their stacking positions. In this regard, it will be noted that each bail structure 14 includes an elongated wall section 42 disposed outwardly of the associated pivot portions 22 and integrally connected therewith. The surface of each wall portion 42 which faces downwardly, when the bail structure is in its stacking position, interengages with the associated surfaces 40 and is provided with a series of longitudinally spaced transversely extending strengthening ribs 44. The ledge surfaces 40 thus provide maximum support for the bail structures 14 at horizontally spaced positions adjacent the juncture thereof with respect to the associated end wall 18.

In addition to the above-mentioned support, an important feature of the present invention is to provide support for the ends of each bail structure along the adjacent end portions of the side walls 20 without extending the ends of the bail structures outwardly of the exterior surfaces of the side walls where they would readily be subject to damage during use. To this end, the upper end portion of each side wall adjacent each end wall is formed with an integral upstanding portion or lug 46 which is spaced inwardly from the exterior surface of the side wall. Formed on each end of each bail structure 14 is a depending end wall portion 48 defining a lug receiving recess 50.

As an optional added precaution, a stop lug 52 is also formed in inwardly spaced relation to each lug 46 in a position to engage the adjacent exterior portion of the end wall portion 48.

Figure 5:
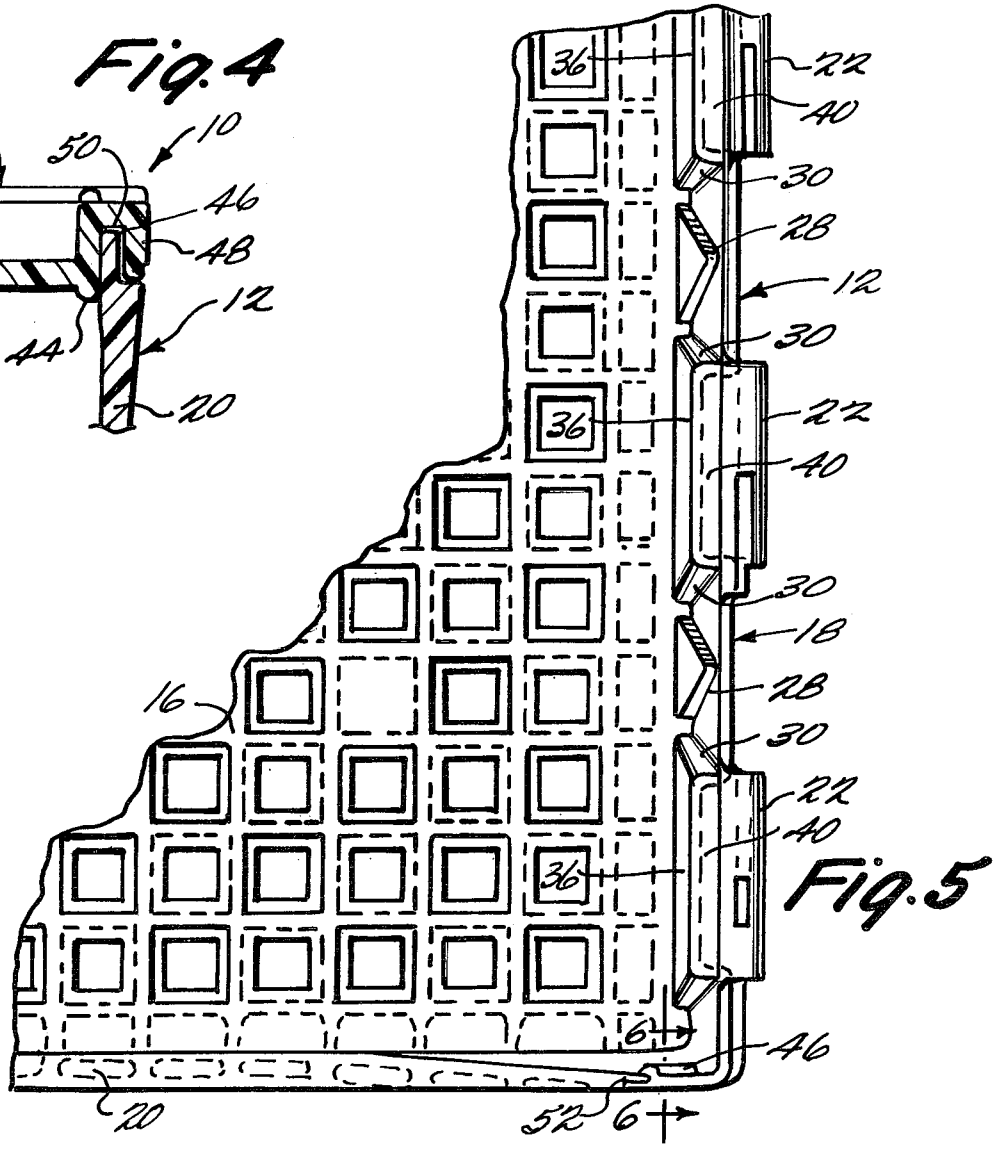
FIG. 5 is a view similar to FIG. 3 with the bail structure removed.
Figure 4:
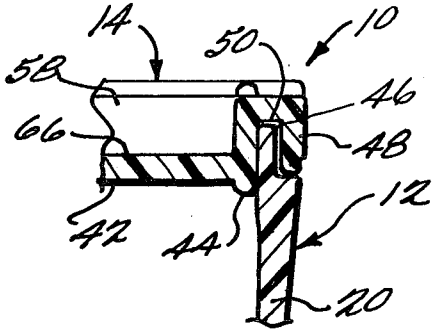
FIG. 4 is an enlarged fragmentary sectional view taken along the line 4—4 of FIG. 3.

As best shown in FIGS. 3–5, when each bail structure 14 is disposed in its stacking position, the end wall portions 48 thereof will engage over the associated lugs 46 with the latter extending within the recesses 50. This structure provides maximum strength and support for the cantilevered portions of the bail structures without extending the ends of the bail structures beyond the exterior surfaces of the side walls.

Figure 6:
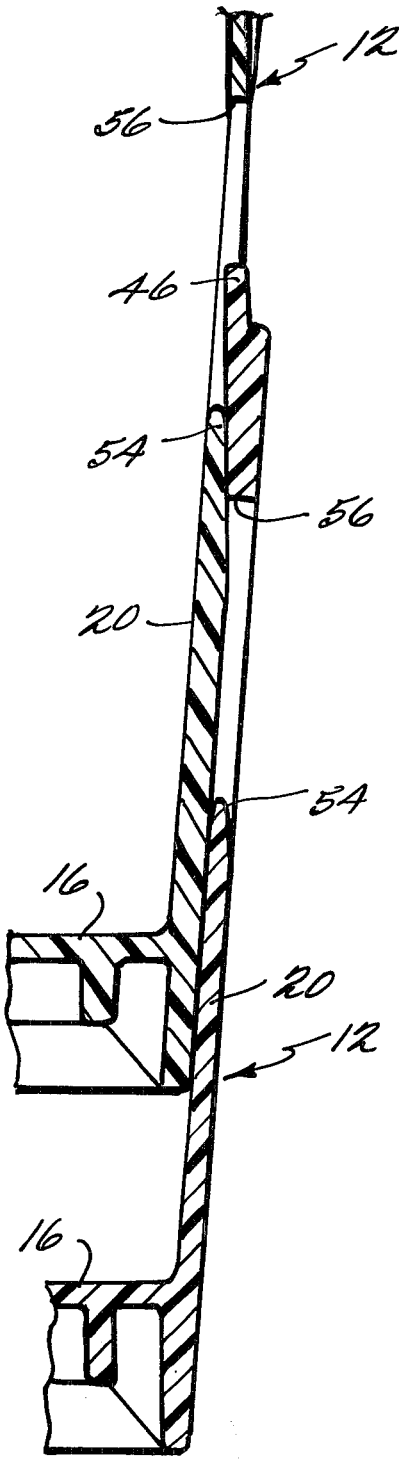
FIG. 6 is an enlarged fragmentary sectional view taken along the line 6—6 of FIG. 5, showing a like container body disposed in nested relation therein.

With reference to FIG. 6, it will be noted that in order to accommodate the lugs 46 during nesting, a portion of each side wall 18 spaced below each lug 46 is relieved along its exterior surface, as indicated at 54, which conveniently may form a cut-out 56.

The above-described constructions relate essentially to the support and strength characteristics provided between the container body 12 and the bail structures 14 when the latter are in their stacking positions, consistent with the nesting capabilities of the container body. In addition, the upper part of the bail structures 14 and the lower parts of the end walls 18 are of complementary construction so that each part will cooperate with the other part of a like container assembly in such a way as to enhance the strength and support characteristics previously described and to otherwise facilitate the movement of two container assemblies 10 into stacked relation. Thus, the wall section 42 of each bail structure 14 has a peripheral wall 58 extending from the surface thereof opposite the ribbed surface thereof. The lower part of each end wall 18 has a stacking rail 60 extending horizontally therealong in a position adjacent the juncture thereof with the bottom wall 16. It will be noted that the lower edges of the panel sections 28 extending downwardly beyond the bottom wall 16 and terminate in surfaces 62 which are disposed on the same horizontal level as downwardly facing surfaces 64 formed on the bottom of the stacking rails 60. It will also be understood that the peripheral wall 58 of each bail structure defines a recessed area 66 on the upper surface of the associated wall section 42 which is of a complementary size to receive the surfaces 62 and 64.

The continuous nature of the support surfaces 64 of the stacking rails 60 enables the container assembly 10 to be initially positioned in laterally overlapping relation to a like container assembly and to be moved into stacked relation thereon by a sliding supported action. In the initial overlapping relation the central portions of the rail surfaces 64 engage the upper end surfaces of the peripheral walls 58 of the lowermost container assembly bail structures in their stacking positions and one of the ends of the stacking rails 60 engages within the central portion of the recessed areas 66. It can be seen that this interengagement will provide sliding support of the uppermost container assembly until the other ends of the stacking rails thereof pass over the ends of the peripheral walls and the stacking rails thus drop down into fully supported engagement with the recessed areas 66. In this stacked relation, the vertically lapped relationship between the stacking rails 60 and peripheral walls 58 will prevent substantial relative horizontal movement between the stacked container assemblies, thus materially stabilizing the stack. Moreover, the engagement of the panel surfaces 62 with the upper surfaces of the wall sections 42 provides a desirable force transmission of the weight of the upper container assembly to the lower container assembly in that this interengagement is essentially between the positions of interengagement of the bail structures with the ledge surfaces 40. Thus while the interengagement of the rail surfaces 64 transmits the load forces in cantilever fashion to the bail structures therebelow, the transmission by the surfaces 62 is in beam fashion. Since there is less deflection in the beam fashion transmission, this action serves as the major support mode.

Referring now more particularly to FIGS. 9-12, certain of the panel sections 28 (e.g. the two sections next to the two outermost sections) have integral stop lug portions extending upwardly from the upper edge thereof providing outwardly facing abutment surfaces 68 (see FIGS. 11 and 12). At corresponding positions, the pivot portions 24 of the bail structures 14 are relieved to provide cooperating abutment surfaces 70. It can be seen that when each bail structure 14 is moved from its stacking position, as shown in FIG. 12, through an arcuate extent slightly greater than 90°, abutment surfaces 68 and 70 will interengage, thus limiting the pivotal movement of the bail structure to the nesting position as shown in FIG. 11.

In accordance with the principles of the present invention integral interengaging cam means is provided for yieldingly restraining the movement of the bail structures out of either the stacking positions or the nesting positions thereof. In the preferred embodiment shown, this means is preferably in the form of buttons or rounded projections 72 and 74 molded integrally on the end surfaces of certain abutting pivot portions 22 and 24 respectively (e.g. the outermost pivot portions 22 and the inwardly adjacent pivot portions 24). It will be understood that the size and shape of these buttons 72 and 74 are so related to the clearance between the pivot portions as to be in general interengagement when the associated bail structure is in either its nesting position, as shown in FIG. 9, or its stacking position as shown in FIG. 10. During the movement of the bail structure between these positions, the buttons 72 and 74 will cam past one another, thus providing the aforesaid yielding resistance.

The bottom wall 16 may be of any conventional construction and, as shown, is preferably perforated with the perforation being provided in accordance with the teachings of commonly assigned U.S. Pat. No. 3,392,875, the disclosure of which is hereby incorporated by reference herein. Except for the lugs 46 and associated structure previously described, the remainder of the side walls 20 may likewise be of any conventional construction. An exemplary embodiment will be apparent by viewing the drawings, particularly FIGS. 1 and 5.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A nestable and stackable container assembly comprising a unitary container body of molded plastic material having a bottom wall and two pairs of opposed side walls integrally joined together and extending upwardly from the periphery of said bottom wall, said side walls being shaped to permit said container body to be nested within a like container body or the latter to be nested therein when disposed in vertically aligned relation therewith, one pair of said opposed side walls including a plurality of horizontally spaced vertically inclined sections extending above said bottom wall, each of said sections defining upwardly facing bail supporting surfaces disposed between the other pair of side walls, a pair of bail structures of molded plastic material mounted along the upper portion of said one pair of opposed side walls for movement between a stacking position wherein each extends inwardly of the adjacent interior surface of the associated side wall toward the opposed side wall in supported relation on the upwardly facing surfaces of said sections and a nesting position wherein each is disposed outwardly of the adjacent interior surface of the associated side wall, said bail structures when in said stacking position defining upwardly facing stacking surfaces for supporting a like container assembly when the container body thereof is disposed in vertically aligned relation above said container body, each side wall of said one pair including a plurality of horizontally spaced upwardly diverging panels extending upwardly and outwardly from said bottom wall between the aforesaid sections provided therein, each of said panels having inwardly directed flanges along the diverging edges thereof forming a part of the aforesaid sections which include a horizontally disposed ledge extending between the upper edges of adjacent flanges of adjacent panels to define said upwardly facing bail supporting surfaces, the aforesaid sections of each side wall of said one pair including a plurality of horizontal elements, each extending horizontally between a pair of adjacent flanges in vertically aligned and spaced relation to the ledge associated therewith, the vertical spacing between said elements and said ledges being less than the nesting height of said container body, and a substantially vertically extending panel integrally interconnecting the inner edges of each associated ledge and horizontal element and the associated flanges extending therebetween, the portions of each of said one pair of side walls extending vertically below said horizontal elements between the associated flanges being open, said horizontal elements defining downwardly facing nesting stop surfaces and the aligned ledges defining upwardly facing nesting stop surfaces.

2. A container assembly as defined in claim 1 wherein each of said one pair of sidewalls has a stacking rail structure formed on the lower part thereof, each rail structure including a portion of said diverging panels extending below said bottom wall and a rail spaced inwardly therefrom extending continuously along the associated side wall, said bail structures including wall sections defining said upwardly facing stacking surfaces, each having a peripheral wall extending therefrom defining a recessed area of a size and shape complementary to the rail structure of the associated side wall.

3. A nestable and stackable container assembly comprising a unitary container body of molded plastic material having a bottom wall and two pairs of opposed side walls integrally joined together and extending upwardly from the periphery of said bottom wall, said side walls being shaped to permit said container body to be nested within a like container body or the latter to be nested therein when disposed in vertically aligned relation therewith, one pair of said opposed side walls including a plurality of horizontally spaced vertically inclined sections extending above said bottom wall, each of said sections defining upwardly facing bail supporting surfaces disposed between the other pair of side walls, a pair of bail structures of molded plastic material mounted along the upper portion of said one pair of opposed side walls for movement between a stacking position wherein each extends inwardly of the adjacent interior surface of the associated side wall toward the opposed side wall in supported relation on the upwardly facing surfaces of said sections and a nesting position wherein each is disposed outwardly of the adjacent interior surface of the associated side wall, said bail structures when in said stacking position defining upwardly facing stacking surfaces for supporting a like container assembly when the container body thereof is disposed in vertically aligned relation above said container body, each of said bail structures being of a longitudinal dimension substantially equal to the largest dimension of the container body in the direction of longitudinal extent thereof and having a portion at each end thereof disposed in depending relation when said bail structure is disposed in said stacking position, said container body having a cooperating portion formed along the upper edge of the other pair of opposed side walls adjacent each juncture thereof with said one pair of side walls spaced inwardly from the exterior extremity of its side wall in a position to engage inwardly of the associated depending portion when the associated bail structure is disposed in said stacking position, each of said other pair of side walls having a portion thereof spaced vertically below each cooperating portion removed from the exterior thereof sufficiently to receive therein a corresponding cooperating portion of a like container body within which said container body is nested, and cooperating means formed integrally on said container body and said bail structures providing cam surfaces interengageable to provide yieldable resistance to the movement of each of said bail structures out of either said stacking position or said nesting position.

4. A nestable and stackable container assembly comprising a unitary container body of molded plastic material having a bottom wall and two pairs of opposed side walls integrally joined together and extending upwardly from the periphery of said bottom wall, said side walls being shaped to permit said container body to be nested within a like container body or the latter to be nested therein when disposed in vertically aligned relation therewith, said container body having vertically spaced upwardly and downwardly facing nesting stop surfaces thereon for preventing said container body from being edged into nested relation with a like container body or the latter from becoming wedged in nested relation therein, a pair of bail structures of molded plastic material mounted along the upper portion of one pair of opposed side walls for movement between a stacking position wherein each extends inwardly of the adjacent interior surface of the associated side wall toward the opposite side wall and a nesting position wherein each is disposed outwardly of the adjacent interior surface of the associated side wall, each of said bail structures being of a longitudinal dimension substantially equal to the largest dimension of the container body in the direction of longitudinal extent thereof and having a portion at each end thereof disposed in depending relation when said bail structure is disposed in said stacking position, said container body having a cooperating portion formed along the upper edge of the other pair of opposed side walls adjacent each juncture thereof with said one pair of side walls spaced inwardly from the exterior extremity of its side wall in a position to engage inwardly of the associated depending portion when the associated bail structure is disposed in said stacking position, each of said other pair of side walls having a portion thereof spaced vertically below each cooperating portion removed from the exterior thereof sufficiently to receive therein a corresponding cooperating portion of a like container body within which said container body is nested, and certain of said pivot portions disposed in interengaged adjacent relation being provided with integral cam surfaces interengageable to provide yieldable resistance to the movement of each of said bail structures out of said nesting position.

5. A container assembly as defined in claim 4 wherein certain of said pivot portions disposed in interengaged adjacent relation are provided with integral stop portions interengageable to limit the pivotal movement of each of said bail structures from said stacking position into said nesting position to an arcuate extent of slightly over 90°.

6. A container assembly as defined in claim 4 wherein each of said one pair of side walls includes a plurality of horizontally spaced upwardly diverging panel sections extending upwardly and outwardly from said bottom wall, each of said panel sections having inwardly directed flanges along the diverging edges thereof, a horizontally extending ledge extending between the upper edges of adjacent flanges of adjacent panel sections, a plurality of horizontal elements each extending horizontally between a pair of adjacent flanges in vertically aligned and spaced relation to the ledge associated therewith, the vertical spacing between said elements and said ledges being less than the nesting height of said container body and a substantially vertically extending panel section integrally interconnecting the inner edges of each associated ledge and element and the associated flanges extending therebetween, the portions of each of said one pair of side walls extending vertically below said elements between the associated flanges being open, said horizontal elements defining said downwardly facing nesting stop surfaces and the aligned ledges defining said upwardly facing nesting stop surfaces when said bail structures are disposed in said nesting position, said bail structures including surfaces engaging the upper surfaces of said ledges including the nesting stop surfaces provided thereby when said bail structures are disposed in said stacking position.

7. A container assembly as defined in claim 4 wherein each of said one pair of side walls includes a rail structure extending continuously along the lower edge thereof, each of said bail structures having a recess formed in the upper surface thereof when disposed in said stacking position which is vertically aligned with an associated rail structure and shaped to receive therein a corresponding rail structure of a similar container body when disposed in stacked relation thereon to stably support the same and prevent substantial horizontal movement in any direction relative thereto.

8. A nestable and stackable container assembly comprising a unitary container body of molded plastic material having a bottom wall and two pairs of opposed side walls integrally joined together and extending upwardly from the periphery of said bottom wall, said side walls being shaped to permit said container body to be nested within a like container body or the latter to be nested therein when disposed in vertically aligned relation therewith, said container body having vertically spaced upwardly and downwardly facing nesting stop surfaces thereon for preventing said container body from being wedged into nested relation with a like container body or the latter from becoming wedged in nested relation therein, a pair of bail structures of molded plastic material mounted along the upper portion of one pair of opposed side walls for pivotal movement between a stacking position wherein each extends inwardly of the adjacent interior surface of the associated side wall toward the opposed side wall and a nesting position wherein each is disposed outwardly of the adjacent interior surface of the associated side wall, interengaging integral abutment means on said bail structures and said container body for limiting the pivotal movement of said bail structures between said stacking and nesting positions and supporting each of the bail structures in each such position and interengaging integral cam surface means on said bail structures and said container body for yieldingly resisting movement of each of said bail structures out of either said stacking position or said nesting position.

9. A container assembly as defined in claim 8 wherein each of said one pair of side walls includes a plurality of longitudinally spaced pivot portions on the upper edge thereof, each of said bail structures including a plurality of pivot portions along one edge thereof spaced to interengage longitudinally with the pivot portions of the associated one side wall and a pivot pin extending through each series of interengaging pivot portions.

10. A container assembly as defined in claim 9 wherein said integral cam surface means are formed on the adjacent end portions of certain adjacent pivot portions.

11. A container assembly as defined in claim 9 wherein said integral cam surfaces are in the form of rounded projections.

12. A container assembly as defined in claim 9 wherein said pivot portions include lateral openings forming a generally continuous longitudinally extending pivot pin receiving opening, said pivot pin having a laterally offset portion disposed in one of said lateral openings.

* * * * *

REEXAMINATION CERTIFICATE (878th)

United States Patent [19]

Clipson et al.

[11] B1 4,109,791

[45] Certificate Issued Jun. 28, 1988

[54] NESTABLE AND STACKABLE CONTAINER ASSEMBLY WITH IMPROVED BAIL STRUCTURES OF MOLDED PLASTIC

[75] Inventors: Stuart A. Clipson, Glendale; Ralph H. Herolzer, Cincinnati, both of Ohio

[73] Assignee: Midland-Ross Corporation, Cleveland, Ohio

Reexamination Request:
No. 90/000,970, Mar. 17, 1986

Reexamination Certificate for:

| | |
|---|---|
| Patent No.: | **4,109,791** |
| Issued: | **Aug. 29, 1978** |
| Appl. No.: | **444,967** |
| Filed: | **Feb. 22, 1974** |

[51] Int. Cl.[4] ..... B65D 21/06
[52] U.S. Cl. ..... 206/506
[58] Field of Search ..... 206/505-507; 220/343

[56] References Cited

U.S. PATENT DOCUMENTS

| | | | |
|---|---|---|---|
| 1,007,478 | 10/1911 | Murray . | |
| 1,676,621 | 7/1928 | Pittelrow | 220/343 |
| 1,709,927 | 4/1929 | Whitney . | |
| 1,759,237 | 5/1930 | McClure . | |
| 2,175,390 | 10/1939 | Harrison | 206/506 |
| 2,244,841 | 6/1941 | Johnson | 206/506 |
| 2,765,099 | 10/1956 | Lively | 206/506 |
| 2,766,901 | 10/1956 | Sunko | 220/343 |
| 2,994,463 | 8/1961 | Drader . | |
| 3,191,796 | 6/1965 | Schwartz | 206/507 |
| 3,204,778 | 9/1965 | Nawman et al. . | |
| 3,272,379 | 9/1966 | Driza et al. . | |
| 3,430,806 | 3/1969 | Munk | 206/507 |
| 3,586,205 | 6/1971 | Van Daaler | 206/506 |

*Primary Examiner*—George E. Lowrance

[57] ABSTRACT

A nestable and stackable container assembly including a nestable container body molded of plastic material and a pair of bail structures also molded of plastic material pivotally mounted on the end walls of the container body for movement between nesting positions permitting a plurality of like container assemblies to nest one within another and stacking positions enabling a plurality of like containers to stack one on top of the other, the end walls and bail structures being constructed to provide strength and support when stacked without providing excessive wall thicknesses or excessive reduction in nesting height or container capacity, the container body and bail structures having integrally formed cooperating rounded projections for yieldingly resisting movement of the bail structures out of either their stacking positions or nesting positions.

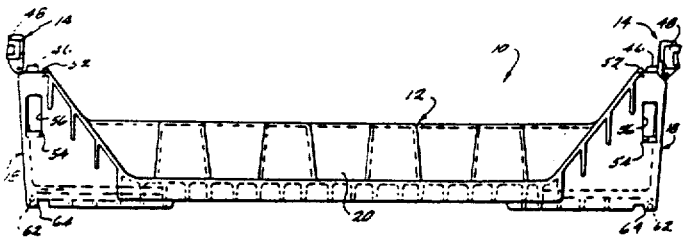

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 and 2 is confirmed.

Claims 3, 4 and 8 are determined to be patentable as amended.

Claims 5–7 and 9–12, dependent on an amended claim, are determined to be patentable.

3. A nestable and stackable container assembly comprising a unitary container body of molded plastic material having a bottom wall and two pairs of opposed side walls integrally joined together and extending upwardly from the periphery of said bottom wall, said side walls being shaped to permit said container body to be nested within a like container body or the latter to be nested therein when disposed in vertically aligned relation therewith, one pair of said opposed side walls including a plurality of horizontally spaced vertically inclined sections extending above said bottom wall, each of said sections defining upwardly facing bail supporting surfaces disposed between the other pair of side walls, a pair of bail structures of molded plastic material mounted along the upper portion of said one pair of opposed side walls for movement between a stacking position wherein each extends inwardly of the adjacent interior surface of the associated side wall toward the opposed side wall in supported relation on the upwardly facing surfaces of said sections and a nesting position wherein each is disposed outwardly of the adjacent interior surface of the associated side wall, said bail structures when in said stacking position defining upwardly facing stacking surfaces for supporting a like container assembly when the container body thereof is disposed in vertically aligned relation above said container body, each of said bail structures being of a longitudinal dimension substantially equal to the largest dimension of the container body in the direction of longitudinal extent thereof and having a portion at each end thereof disposed in depending relation when said bail structure is disposed in said stacking position, said container body having a cooperating portion formed along the upper edge of the other pair of opposed side walls adjacent each juncture thereof with said one pair of side walls spaced inwardly from the exterior extremity of its side wall in a position to engage inwardly of the associated depending portion when the associated bail structure is disposed in said stacking position, each of said other pair of side walls having a portion thereof spaced vertically below each cooperating portion removed from the exterior thereof sufficiently to receive therein a corresponding cooperating portion of a like container body within which said container body is nested, and cooperating means formed integrally on said container body and said bail structures providing cam surfaces *on and projecting from said container body and said bail structure, said cam surfaces being* interengageable to provide yieldable resistance to the movement of each of said bail structures out of either said stacking position or said nesting position.

4. A nestable and stackable container assembly comprising a unitary container body of molded plastic material having a bottom wall and two pairs of opposed side walls integrally joined together and extending upwardly from the periphery of said bottom wall, said side walls being shaped to permit said container body to be nested within a like container body or the latter to be nested therein when disposed in vertically aligned relation therewith, said container body having vertically spaced upwardly and downwardly facing nesting stop surfaces thereon for preventing said container body from being edged into nested relation with a like container body or the latter from becoming wedged in nested relation therein, a pair of bail structures of molded plastic material mounted along the upper portion of one pair of opposed side walls for movement between a stacking position wherein each extends inwardly of the adjacent interior surface of the associated side wall toward the opposite side wall and a nesting position wherein each is disposed outwardly of the adjacent interior surface of the associated side wall, each of said bail structures being of a longitudinal dimension substantially equal to the largest dimension of the container body in the direction of longitudinal extent thereof and having a portion at each end thereof disposed in depending relation when said bail structure is disposed in said stacking position, said container body having a cooperating portion formed along the upper edge of the other pair of opposed side walls adjacent each juncture thereof with said one pair of side walls spaced inwardly from the exterior extremity of its side wall in a position to engage inwardly of the associated depending portion when the associated bail structure is disposed in said stacking position, each of said other pair of side walls having a *pivot* portion thereof spaced vertically below each cooperating portion removed from the exterior thereof sufficiently to receive therein a corresponding cooperating portion of a like container body within which said container body is nested, and certain of said pivot portions disposed in interengaged adjacent relation being provided with integral cam surfaces, *said cam surfaces being on and projecting from said container body and said bail structure, said cam surfaces being* interengageable to provide yieldable resistance to the movement of each of said bail structures out of said nesting position.

8. A nestable and stackable container assembly comprising a unitary container body of molded plastic material having a bottom wall and two pairs of opposed side walls integrally joined together and extending upwardly from the periphery of said bottom wall, said side walls being shaped to permit said container body to be nested within a like container body or the latter to be nested therein when disposed in vertically aligned relation therewith, said container body having vertically spaced upwardly and downwardly facing nesting stop surfaces thereon for preventing said container body from being wedged into nested relation with a like container body or the latter from becoming wedged in nested relation therein, a pair of bail structures of molded plastic material mounted along the upper portion of one pair of opposed side walls for pivotal movement between a stacking position wherein each extends inwardly of the adjacent interior surface of the associated side wall toward the opposed side wall and a nesting position wherein each is disposed outwardly of the adjacent interior surface of the associated side wall, interengaging integral abutment means on said bail structures and said container body for limiting the pivotal movement of said bail structures between said stacking and nesting positions and supporting each of the bail structures in each such position and interengaging integral cam surface means on *and projecting from both* said bail structure and said container body for yieldingly resisting movement of each of said bail structures out of either said stacking position or said nesting position.

* * * * *